US009441881B2

(12) United States Patent
Berner

(10) Patent No.: US 9,441,881 B2
(45) Date of Patent: Sep. 13, 2016

(54) OXIDATION FURNACE

(75) Inventor: Karl Berner, Altdorf (DE)

(73) Assignee: EISENMANN AG, Boeblingen (DE)

( * ) Notice: Subject to any disclaimer, the term of this patent is extended or adjusted under 35 U.S.C. 154(b) by 950 days.

(21) Appl. No.: 13/577,506

(22) PCT Filed: Jan. 26, 2011

(86) PCT No.: PCT/EP2011/000318

§ 371 (c)(1),
(2), (4) Date: Aug. 7, 2012

(87) PCT Pub. No.: WO2011/098215

PCT Pub. Date: Aug. 18, 2011

(65) Prior Publication Data

US 2012/0304480 A1 Dec. 6, 2012

(30) Foreign Application Priority Data

Feb. 9, 2010 (DE) ..... 10 2010 007 481

(51) Int. Cl.

| | |
|---|---|
| ***F27B 9/28*** | (2006.01) |
| ***F26B 13/00*** | (2006.01) |
| ***F26B 13/08*** | (2006.01) |
| ***D02J 13/00*** | (2006.01) |
| ***D01F 9/32*** | (2006.01) |
| *F26B 21/02* | (2006.01) |
| *F26B 23/02* | (2006.01) |

(52) U.S. Cl.

CPC ..... *F26B 13/005* (2013.01); *D01F 9/32* (2013.01); *D02J 13/001* (2013.01); *F26B 13/08* (2013.01); *F26B 21/02* (2013.01); *F26B 23/022* (2013.01)

(58) Field of Classification Search

CPC ..... C21D 9/56; F27B 9/10; F27B 9/28; F26B 13/105

USPC ..... 432/8, 59; 34/224, 232, 620, 635, 638

See application file for complete search history.

(56) References Cited

U.S. PATENT DOCUMENTS

| | | | | |
|---|---|---|---|---|
| 4,515,561 A * | 5/1985 | Melgaard | D01F 9/32 | 126/21 A |
| 4,559,010 A | 12/1985 | Katsuki et al. | | |
| 5,263,265 A | 11/1993 | Melgaard | | |
| 5,908,290 A * | 6/1999 | Kawamura | D01F 9/32 | 34/636 |

(Continued)

FOREIGN PATENT DOCUMENTS

| | | |
|---|---|---|
| DE | 34 07 909 A1 | 9/1984 |
| EP | 0 848 090 A2 | 6/1998 |
| JP | 2009242962 A | 10/2009 |

*Primary Examiner* — Gregory A Wilson

(74) *Attorney, Agent, or Firm* — Factor Intellectual Property Law Group, Ltd.

(57) ABSTRACT

An oxidation furnace for the oxidative treatment of fibers, especially for producing carbon fibers, which comprises a process chamber arranged inside a housing, a blowing device for hot air, at least one suction device arranged in an end region of the process chamber, at least one ventilator that circulates the hot air through the blowing device, the process chamber and the suction device, and at least one heating device arranged in the flow path of the hot circulated air. The suction device is formed from a plurality of vertically interspaced suction boxes. Said boxes have at least one outlet for the hot air, and at least one inlet for hot air, communicating with the process chamber and arranged in the outward-facing side of the suction boxes, that is the side that is at a distance from the center of the process chamber.

3 Claims, 4 Drawing Sheets

(56) References Cited

U.S. PATENT DOCUMENTS 6,027,337 A * 2/2000 Rogers ..... D01F 9/32 432/242
6,776,611 B1 * 8/2004 Sprague ..... D01F 9/32 432/242
7,004,753 B2 * 2/2006 Stockhausen ..... D01F 9/32 34/444
7,335,018 B2 * 2/2008 Yamaguchi ..... D01F 9/32 432/59
2014/0026437 A1 * 1/2014 Meinecke ..... F27B 9/28 34/634

* cited by examiner

OXIDATION FURNACE

RELATED APPLICATIONS

This application claims the filing benefit of International Patent Application No. PCT/EP2011/000318, filed Jan. 26, 2011, which claims the filing benefit of German Patent Application No. 10 2010 007 481.0, filed Feb. 9, 2010, the contents of both of which are incorporated herein by reference.

TECHNICAL FIELD AND BACKGROUND OF THE INVENTION

The invention relates to an oxidation furnace for the oxidative treatment of fibres, particularly for producing carbon fibres, having a) a housing which is gastight apart from inlet and outlet regions for the fibres;
b) a process chamber located in the interior of the housing;
c) a blowing device by means of which hot air can be blown into the process chamber;
d) at least one suction device which is arranged in an end region of the process chamber, extracts hot air from the process chamber and comprises a plurality of suction boxes which are arranged at a vertical spacing from one another and have at least one outlet opening for the hot air and, on one side, at least one inlet opening for the hot air, which communicates with the process chamber;
e) at least one ventilator which circulates the hot air through the blowing device, the process chamber and the suction device;
f) at least one heating device located in the flow path of the hot circulated air;
g) guide rollers which guide the fibres in serpentine manner through the clearances between suction boxes located above one another.

There are various ways of conducting the hot air for treating fibres through an oxidation furnace. The flow direction can be aligned transversely, vertically or even horizontally to the direction of the fibres here. Oxidation furnaces which conduct the air according to the "centre-to-end" principle are gaining increasing acceptance. In this, the hot air is blown out in the central region of the process chamber in both directions, that is in the direction of the opposite ends of the process chamber, and extracted again by suction devices at these two ends of the process chamber. The description below refers to "centre-to-end" air conduction by way of example, although the invention is not restricted to this.

The process chamber can also be seen as a zone which is repeated in the longitudinal direction of the furnace for different temperatures and air flows.

In known oxidation furnaces of the type mentioned at the outset, the suction openings of the suction boxes which communicate with the process chamber are located on that side which faces the centre of the process chamber. As a result, hot air no longer flows through the clearances between the suction boxes, at least not to any notable extent. Therefore, the paths covered by the fibres between the suction boxes are not used for the oxidative treatment. Since the suction boxes need to have considerable dimensions owing to the air distribution, the stretches in which there is no oxidative treatment of the fibres due to a lack of air flow are by no means insignificant.

SUMMARY OF THE INVENTION

An object of the present invention is to design an oxidation furnace of the type mentioned at the outset so that a stipulated stretch of the oxidative treatment of the fibres can be accommodated in a relatively small volume of the furnace, and in particular the furnace can be of a lower construction.

This object may be achieved according to the invention in that h) at least one inlet opening communicating with the process chamber is provided in the outwardly facing side of the suction boxes, that is the side remote from the centre of the process chamber.

With the measure according to the invention, at least some of the hot air flows further outwards between the suction boxes to the end of the process chamber and is only then deflected by the suction effect at the inlet openings located on the outer sides of the suction boxes, removed and supplied back to the air circuit. As a result, the fibres can also be surrounded and oxidised by hot air in the clearances between the suction boxes. Overall, this enables a smaller construction of the oxidation furnace since better use is made of the paths covered by the fibres than in the prior art.

It is particularly useful that, with the same furnace length, the furnace can be kept lower. This is linked to a whole range of advantages: since few serpentine passages of the fibres through the process chamber are required, it is possible to save on deflection rollers for the filaments and lock devices which prevent air from escaping in the region where the filaments enter and exit the process chamber. Moreover, the entire furnace is lower in weight, which is favourable in terms of expenditure on a steel structure on which the furnace is constructed. Moreover, the improved air flow around the filaments in the process chamber increases the quality of the resultant product.

It is particularly expedient with "centre-to-end" air conduction if inlet openings communicating with the process chamber are provided in two opposite sides of the suction boxes. The choice of the overall cross-sections of the inlet openings located on opposite sides can be used to specify the proportion of air which is not already extracted at the inwardly facing inlet openings but instead flows outwards through the clearances between the suction boxes.

In a preferred embodiment of the oxidation furnace according to the invention, lock devices, which have an air chamber for each clearance located between the suction boxes, are provided in the inlet regions of the housing, which air chamber communicates with said clearance and is separated from the outer atmosphere by a closing wall, which only has orifices for the fibres, and can be acted upon by pressurised air. This pressurised fresh air reliably ensures that the hot air which originates from the process chamber and flows through the clearances between the suction boxes cannot escape from the furnace. Only the pressurised air in the respective clearances which itself originates from the outer atmosphere ultimately passes through the closing wall into the outer atmosphere.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawing which shows.

DETAILED DESCRIPTION OF THE PRESENT INVENTION

Figure 1:
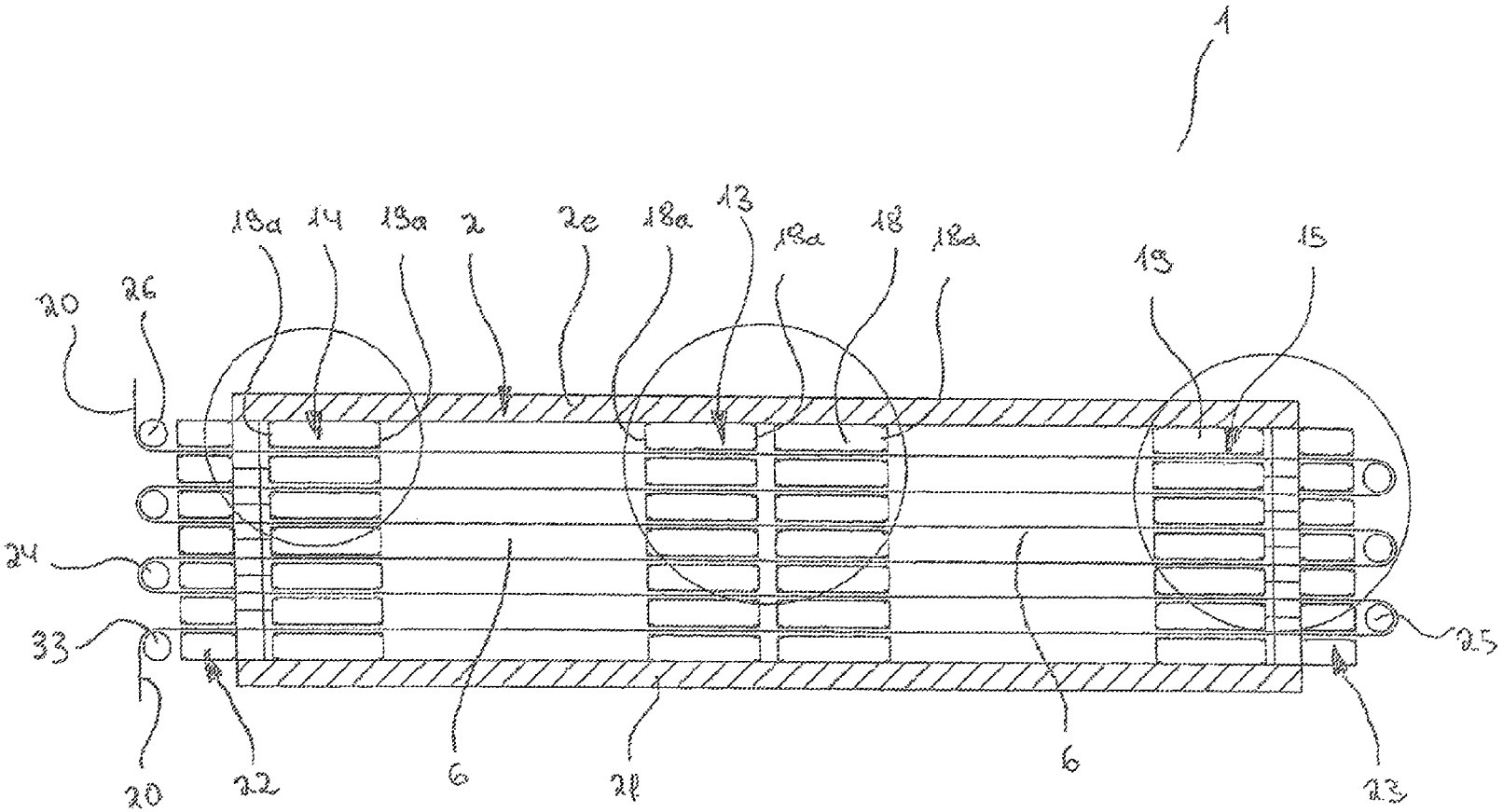
FIG. 1 a vertical section through an oxidation furnace for producing carbon fibres according to line I-I of FIG. 2.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
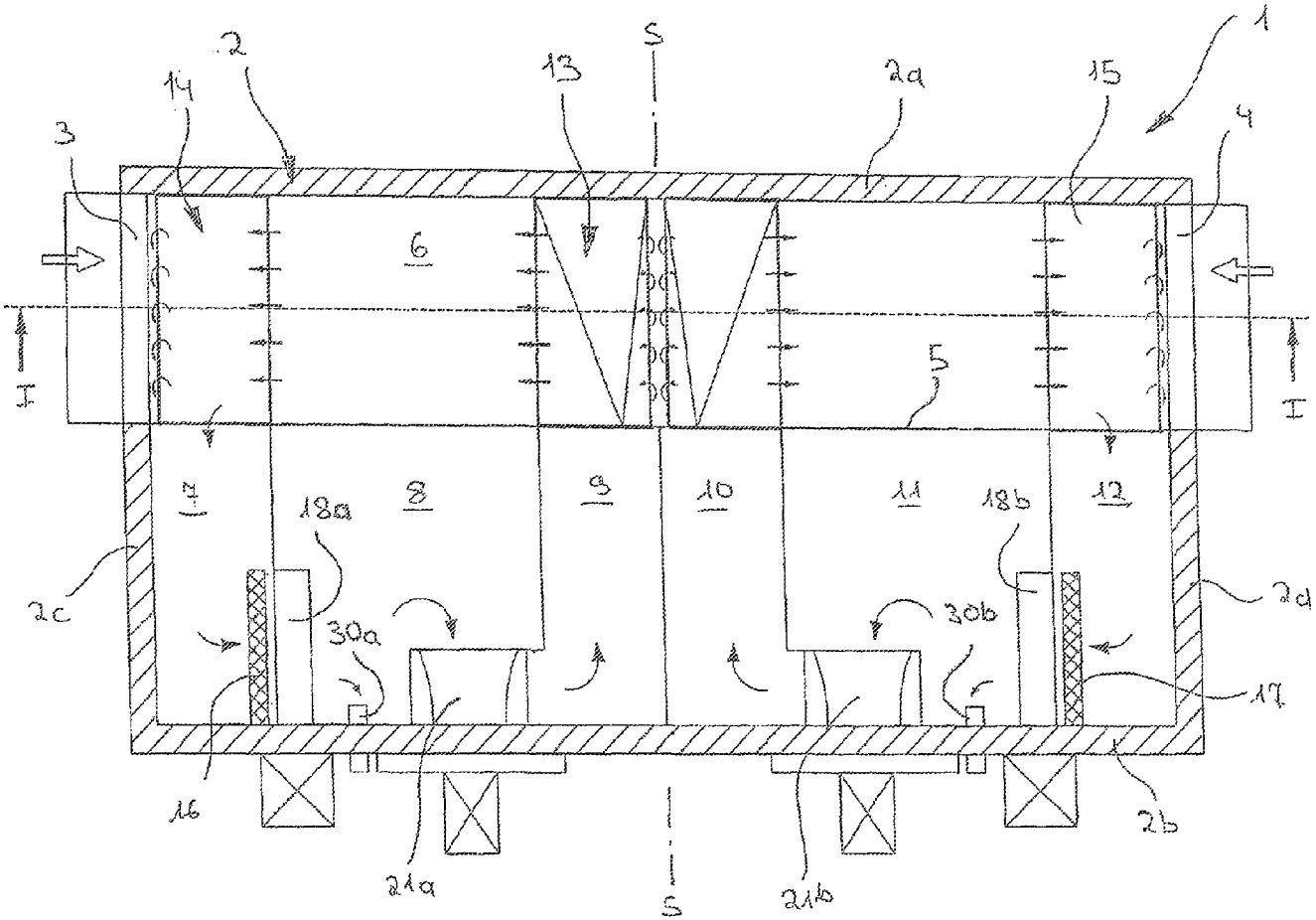
FIG. 2 a horizontal section through the oxidation furnace of FIG. 1.
Figure 3:
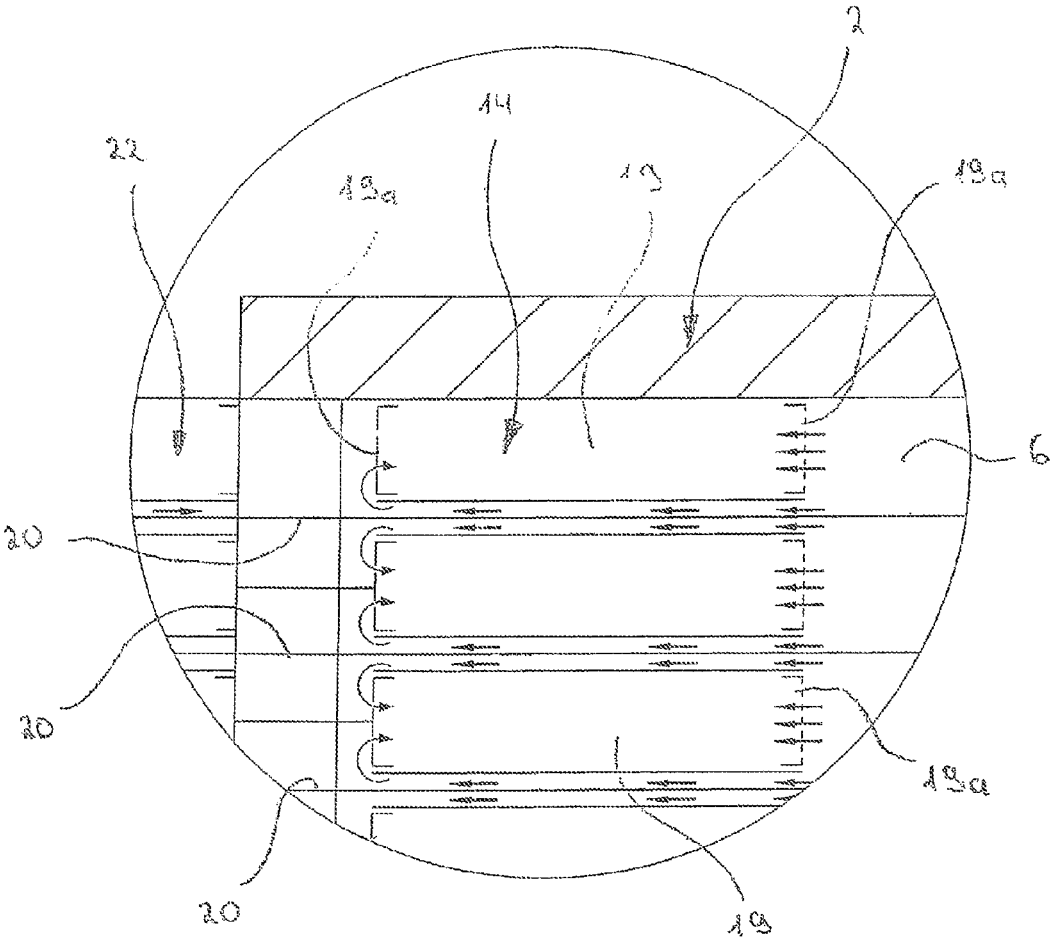
FIG. 3 a detailed enlargement from FIG. 1 in the region of a suction device.

Reference is firstly made to FIGS. 1 to 3, which show an oxidation furnace which is denoted as a whole by the reference numeral 1 and is used to produce carbon fibres. The oxidation furnace 1 comprises a housing 2 which is in turn composed of two vertical side walls 2*a*, 2*b*, two vertical end walls 2*c*, 2*d*, a top wall 2*e* and a base wall 2*f*. The housing 2 is gastight with the exception of two regions 3, 4 in the end walls 2*c* and 2*d*, in which the fibres 20 to be treated are conducted in and out and which are provided with special lock devices 22.

As shown in particular in FIG. 2, the interior of the housing 2 is divided by a vertical partition wall 5 into the actual process chamber 6 and air-conducting chambers 7, 8, 9, 10, 11, 12 located at the side of this process chamber. On the whole, the interior of the oxidation furnace 1 is constructed to be substantially mirror-symmetrical with respect to the vertical central plane S-S indicated in FIG. 2.

A blowing device, which is denoted as a whole by the reference numeral 13 and explained in more detail below, is located in the central region of the process chamber 6. Suction devices 14 and 15, which are likewise described in more detail below, are located in the two outer end regions of the process chamber 6, respectively adjacent to the entry and exit region 3, 4.

Two directionally opposed air circuits are maintained inside the housing 2: Starting for example from the suction devices 14, 15, the air is conducted in the direction of the arrows shown in FIG. 2 through the air-conducting chambers 7 and 12 to a filter 16 and 17 and then through a heating unit 18*a* and 18*b* into the air-conducting chamber 8 and 11. The heated air is extracted from the air-conducting chamber 8 and 11 by a ventilator 21*a* and 21*b* and blown into the air-conducting chambers 9 and 10. From there, the air arrives in each case in one half of the blowing device 13, flowing in opposite directions from there into the process chamber 6 and from there to the suction device 14 and 15 whereby the two air circuits are closed.

Two outlets 30*a*, 30*b* are provided in the wall of the housing 2. These can be used to discharge those volumes of gas or air which are either produced during the oxidation process or arrive in the process chamber 6 as fresh air by way of the entry and exit regions 3, 4 so as to maintain the air balance in the oxidation furnace 1.

The discharged gases, which can also contain toxic constituents, are supplied for thermal after-burning. The heat produced thereby can be used at least to pre-heat the fresh air supplied to the oxidation furnace 1.

The detailed construction of the blowing device 13 is described as follows:

It comprises two "stacks" of blowing boxes 18. Each of these blowing boxes 18 is in the shape of a hollow cuboid, with the longer dimension extending transversely to the longitudinal direction of the process chamber 6 over its entire width. The narrow sides of the blowing boxes 18, which each face the process chamber 6, are constructed as perforated plates 18*a*. A respective end face of each blowing box 18 is in communication with the air-conducting chamber 9 and air-conducting chamber 10 so that the air delivered by the ventilator 21*a* and 21*b* is blown into the interior of the respective blowing box 18 and can exit from there by way of the perforated plates 18*a*.

The various blowing boxes 18 in each of the two stacks are arranged at a slight spacing above one another; the two stacks of blowing boxes 18, as seen in the longitudinal direction of the furnace or the movement direction of the filaments 20, are in turn likewise spaced from one another. Ideally (and deviating from the relationships shown in FIG. 1), the vertical spacing between two blowing boxes 18 in a stack is the same as the spacing between the two stacks 18 in the longitudinal direction of the process chamber 6.

The two suction devices 14, 15, of which the left-hand suction device in FIGS. 1 and 2 is denoted by the reference numeral 14 in FIG. 3, are formed substantially by a respective stack of suction boxes 19 which extend in a manner similar to the blowing boxes 18 in the transverse direction through the entire process chamber 6 and are constructed as perforated plates 19*a* at their narrow sides extending transversely to the longitudinal extent of the process chamber 6. The holes in the perforated plates 19*a* can be of any geometrical shape here. The suction boxes 19 in the suction devices 14, 15 are at the same vertical spacing from one another as the blowing boxes 18 in the blowing device 13.

The air flows in the region of the suction device 14 are shown by arrows in FIG. 3. A considerable proportion of the air coming from the central region of the process chamber 6 passes over the perforated plate 19*a* facing the centre of the process chamber 6 into the interior spaces of the suction boxes 19 and is circulated further from there as described above. A further proportion of the air coming from the central region of the process chamber 6 flows through the clearances between the suction boxes 19 located above one another and is likewise sucked through the outer perforated plate 19*a* of the suction boxes 19 into the interior of the suction boxes 19 and, from there, supplied to the further air circuit.

The fibres 20 to be treated are supplied to the oxidation furnace 1 by way of a deflection roller 33 and pass through a lock device 22 here, which is not yet shown in precise detail in FIGS. 1 and 3 and serves to prevent gas from escaping outwards from the process chamber 6. The fibres 20 are then guided through the clearances between suction boxes 19 located above one another, through the process chamber 6, through the clearances between blowing boxes 18 located above one another in the blowing device 13, through the clearance between suction boxes 19 located above one another at the opposite end of the process chamber 6 and through a further lock device 22.

The outlined passage of the fibres 20 through the process chamber 6 is repeated a plurality of times in serpentine manner, for which a plurality of deflection rollers 24 and 25 with their axes arranged parallel above one another are provided in both end regions of the oxidation furnace 1. After the uppermost passage through the process chamber 6, the fibres 20 exit the oxidation furnace 1 and are guided here by way of a further deflection roller 26. During the serpentine passage of the fibres 20 through the process chamber 6, these are surrounded by hot, oxygen-containing air and thereby oxidised. The exit from the oxidation furnace substantially completes at least one oxidation stage. Further oxidation stages can follow.

As a result of the perforated plates 19*a* provided on both narrow longitudinal sides of the suction boxes 19, the hot air can enter the interior of the suction boxes 19 at their two opposite sides. This means that, contrary to the prior art, air also flows through the clearances between the suction boxes 19 located above one another and the portions of the fibres 20 which are located here are surrounded by air. Contrary to the prior art, these paths are therefore effective for the oxidation procedure. Therefore, with the same furnace length, it is possible to reduce the furnace height compared to oxidation furnaces according to the prior art as outlined at the outset. The advantages linked to this have already been referred to above.

Figure 4:
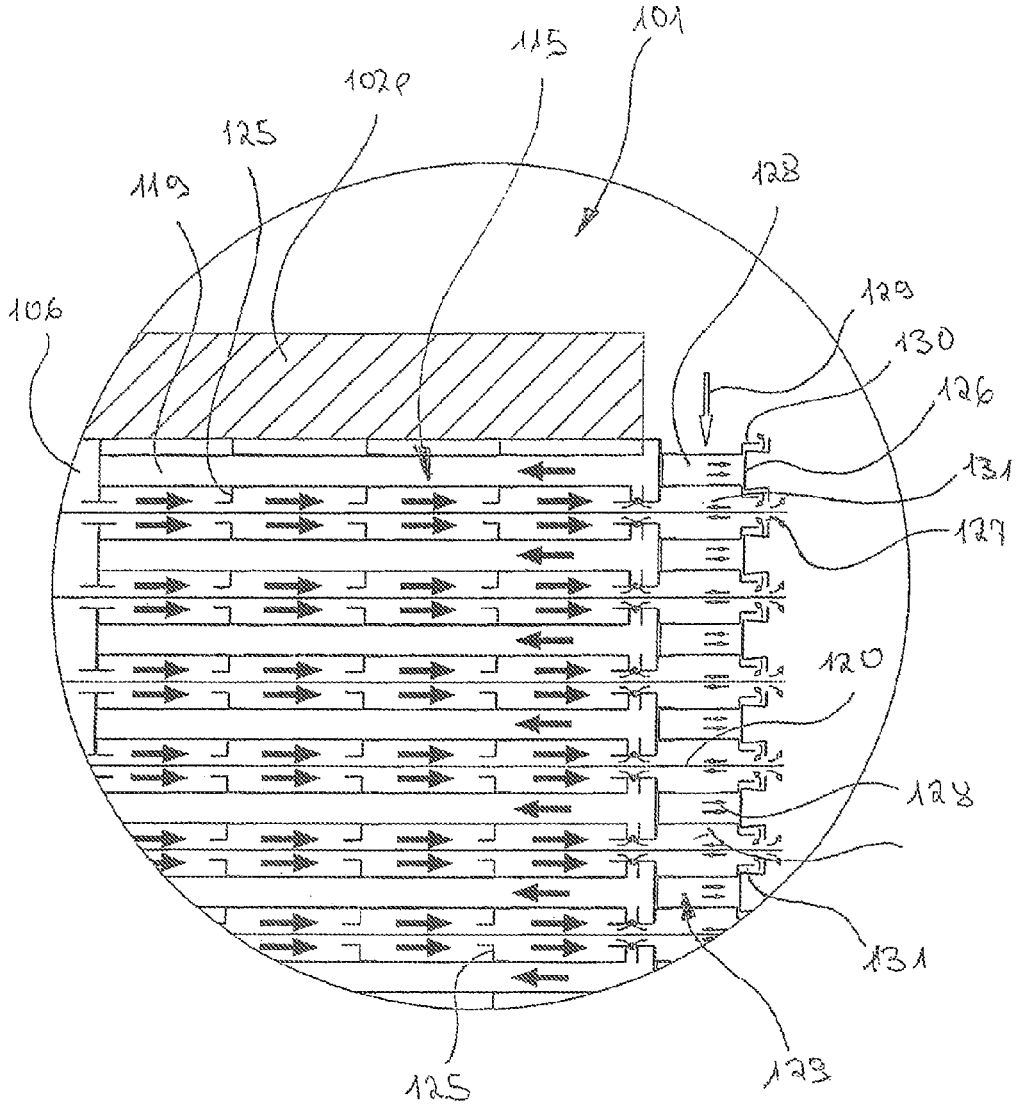
FIG. 4 a section, similar to FIG. 3, but shown in greater detail.

Whilst the above-described exemplary embodiment of an oxidation furnace is specifically designed for "centre-to-end" air conduction, the exemplary embodiment described below with reference to FIG. 4 is suitable for all manners of air conduction, i.e. also for air conduction which proceeds vertically or horizontally perpendicular to the direction of the fibres.

In a manner similar to FIG. 3, FIG. 4 illustrates a vertical section through an end region of an oxidation furnace 101 which is similar to that of FIG. 3 but is more detailed in terms of the lock device 123. In the oxidation furnace 101 of FIG. 4, the suction devices 115 are also formed by a stack of suction boxes 119 located above one another. Contrary to the suction boxes 19 of the first exemplary embodiment, the suction boxes 119 of FIG. 4 are only provided with entry openings for the gas on the outwardly facing narrow side, whilst the opposite narrow side, which faces the centre of the process chamber 6, is closed.

Angle profiles 125, which extend transversely to the flow direction of the air (indicated by arrows) are mounted on the top and bottom sides of the suction boxes 119. These angle profiles 125 have the task of increasing the air resistance and ensuring uniform suction. An individually adjustable throttle valve (not illustrated) can be provided for each suction box 119 in the air path between the suction boxes 119 and the air-conducting chambers 7 and 12 of FIG. 2 in order to maintain the same extracted volume flow for each suction box 119.

The lock device 123 comprises an outer, folded, profiled plate 126 as a closing wall against the outer atmosphere, which is provided with corresponding through openings 127 at those points in which the filaments 120 pass through. An air channel 128, which can be supplied with pressurised fresh air in the direction of the arrow 129, is mounted at the height of each suction box 119. Air-deflector plates 130 which are angled at the air channel 128 are integrally moulded or mounted at the end adjacent to the plate 126. As illustrated in the drawing and symbolised by small arrows, narrow passages for the air are produced between these air-deflector plates 130 and the plate 126 and thus reach particularly into the region of the openings 127 in the plate 126.

A further proportion of the air flows in the direction of the process chamber 106, arrives in a respective air chamber 131 and then meets the air flowing outwards through the clearances between the suction boxes 119. As a result, both air flows deviate upwards and downwards and now arrive in the region of the open narrow sides of the suction boxes 119. From there, they are extracted through the interior spaces of the various suction boxes 119.

Owing to the overpressure of the air introduced into the air channels 128 and therefore into the air chambers 131, it is not possible for potentially harmful gases from the interior of the oxidation furnace 1 to escape out of the oxidation furnace 101.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An oxidation furnace for the oxidative treatment of fibres comprising:

a) a housing which is gastight apart from inlet and outlet regions for fibres;

b) a process chamber located in an interior of the housing;

c) a blowing device by means of which hot air is blown into the process chamber;

d) at least one suction device which is arranged in an end region of the process chamber, and which extracts hot air from the process chamber and comprises a plurality of suction boxes which are arranged at a vertical spacing from one another and have at least one outlet opening for the hot air and, on one side, at least one inlet opening for hot air, which communicates with the process chamber;

e) at least one ventilator which circulates the hot air through the blowing device, the process chamber and the suction device;

at least one heating device located in a flow path of the hot air;

g) guide rollers which guide the fibres in serpentine manner through clearances between suction boxes located above one another; and h) the at least one inlet opening communicating with the process chamber is provided in an outwardly facing side of each suction box, wherein the outwardly facing side is a side remote from the centre of the process chamber.

2. The oxidation furnace according to claim 1, wherein inlet openings communicating with the process chamber are provided in two opposite sides of the suction boxes.

3. The oxidation furnace according to claim 1, further comprising:

lock devices, which have an air chamber for each clearance located between the suction boxes, are provided in the inlet regions of the housing, which air chamber communicates with said clearance and is separated from an outer atmosphere by a closing wall, which only has orifices for the fibres, and can be acted upon by pressurised air.

* * * * *